US010902822B2

(12) United States Patent
Yoo et al.

(10) Patent No.: US 10,902,822 B2
(45) Date of Patent: Jan. 26, 2021

(54) DISPLAY DEVICE AND METHOD OF CORRECTING MURA IN THE SAME

(71) Applicant: Samsung Display Co., Ltd., Yongin-si (KR)

(72) Inventors: Byoung Seok Yoo, Seoul (KR); Hoi Sik Moon, Hwaseong-si (KR); Jeongwoon Lee, Cheonan-si (KR)

(73) Assignee: Samsung Display Co., Lid., Yongin-si (KR)

( * ) Notice: Subject to any disclaimer, the term of this patent is extended or adjusted under 35 U.S.C. 154(b) by 0 days.

(21) Appl. No.: 16/507,576

(22) Filed: Jul. 10, 2019

(65) Prior Publication Data

US 2020/0027424 A1 Jan. 23, 2020

(30) Foreign Application Priority Data

Jul. 18, 2018 (KR) ..... 10-2018-0083590

(51) Int. Cl.
*G09G 5/10* (2006.01)
*G09G 5/39* (2006.01)
*G09G 3/36* (2006.01)

(52) U.S. Cl.
CPC ..... *G09G 5/10* (2013.01); *G09G 5/39* (2013.01); *G09G 3/3607* (2013.01); *G09G 2320/029* (2013.01); *G09G 2320/0233* (2013.01)

(58) Field of Classification Search
CPC ... G09G 2320/0233; G09G 2320/0285; G09G 2320/029; G09G 3/20; G09G 3/3607; G09G 5/10; G09G 5/39
USPC ..... 345/89
See application file for complete search history.

(56) References Cited

U.S. PATENT DOCUMENTS 8,743,215 B1 * 6/2014 Lee ..... G09G 3/006 348/189
9,761,184 B2 9/2017 Kim et al.
9,805,686 B2 10/2017 Jung et al.
10,276,076 B2 * 4/2019 Zhang ..... G09G 3/36
2011/0012908 A1 1/2011 Daly
(Continued)

FOREIGN PATENT DOCUMENTS

KR 10-2015-0030013 A 3/2015
KR 10-2017-0078959 A 7/2017
KR 10-2017-0106527 A 9/2017

*Primary Examiner* — Tony O Davis
(74) *Attorney, Agent, or Firm* — Lewis Roca Rothgerber Christie LLP

(57) ABSTRACT

A display device includes: a first memory storing mura correcting data respectively corresponding to a plurality of reference pixels, each of the plurality of reference pixels comprising (n×m) pixels, the mura correcting data configured to correct mura of a reference pixel ('n' and 'm' are natural numbers being equal to or more than 2); a first correction controller configured to generate mura correcting data of a pixel using the mura correcting data of the reference pixel stored in the first memory; a second memory storing spot correcting data respectively corresponding to a plurality of spot-muras; a second correction controller configured to output the spot correcting data from the second memory based on a position data of the spot-mura; and an operation part configured to correct pixel data of the pixel using the mura correcting data and the spot correcting data of the pixel.

20 Claims, 9 Drawing Sheets

(56) References Cited

U.S. PATENT DOCUMENTS

| | | | | |
|---|---|---|---|---|
| 2015/0356929 | A1* | 12/2015 | Zhan | G09G 3/20 345/690 |
| 2016/0012759 | A1* | 1/2016 | Kim | G01N 21/956 345/89 |
| 2016/0148582 | A1* | 5/2016 | Chung | G09G 3/3611 345/89 |
| 2016/0171939 | A1* | 6/2016 | Na | G09G 3/2003 345/690 |
| 2018/0190213 | A1* | 7/2018 | Zhang | G09G 3/36 |
| 2018/0301071 | A1* | 10/2018 | Zhang | G09G 3/006 |
| 2019/0189083 | A1* | 6/2019 | Lee | G09G 5/10 |
| 2019/0191150 | A1* | 6/2019 | Zhang | H04N 17/04 |
| 2019/0258890 | A1* | 8/2019 | Lee | G09G 5/026 |

* cited by examiner

FIG. 6

721

DEPTH(DP)

| | | 24 X 12 = [287:0] | | | | | | | | | | | |
|---|---|---|---|---|---|---|---|---|---|---|---|---|---|
| | | [119:0] | | | | | | | | | | | |
| T1 | AD1 | A0 | A1 | A2 | A3 | A4 | A5 | A6 | | | | | |
| T2 | AD2 | A5 | A6 | B0 | B1 | B2 | B3 | B4 | B5 | V6 | | | |
| T3 | AD3 | B3 | B4 | B5 | B6 | C0 | C1 | C2 | C3 | C4 | C5 | C6 | |
| T4 | AD4 | C1 | C2 | C3 | C4 | C5 | C6 | | | | | | |
| T5 | AD5 | C6 | D0 | D1 | D2 | D3 | D4 | D5 | D6 | | | | |
| T6 | AD6 | D4 | D5 | D6 | E0 | E1 | E2 | E3 | E4 | E5 | E6 | | |
| T7 | AD7 | E2 | E3 | E4 | E5 | E6 | | | | | | | |

TIME

FIG. 7A

| MODE | 21 | 18 | 15 | 12 | WORD(WD) (GCD) |
|---|---|---|---|---|---|
| bit | 168 | 144 | 120 | 96 | 24 |

FIG. 7B

| (1)IN_DATA | (2)OUT_DATA | | (3)IN+OUT | (4)GCD[(1),(2)] | DEPTH(DP) (=((3)-(4))/WD) |
|---|---|---|---|---|---|
| 168bit | 21 | 168bit | 336bit | 168bit | 7 |
| | 18 | 144bit | 312bit | 24bit | 12 |
| | 15 | 120bit | 288bit | 24bit | 11 |
| | 12 | 96bit | 264bit | 24bit | 10 |

DISPLAY DEVICE AND METHOD OF CORRECTING MURA IN THE SAME

This application claims priority to and the benefit of Korean Patent Application No. 10-2018-0083590 filed on Jul. 18, 2018, the entirety of which is hereby incorporated by reference herein.

BACKGROUND OF THE INVENTION

1. Field

Aspects of some example embodiments of the inventive concept relate to a display device and a method of correcting mura in the display device.

2. Description of the Related Art

Generally, a display device may include a liquid crystal display (LCD) and an organic light emitting display (OLED).

The display device includes the display panel and the panel driving circuit that drives the display panel.

The manufacturing process of the display device includes the visual inspection process for inspecting electrical and optical operating conditions. The visual inspection process carries out a mura correction process according to the physical characteristics of the manufacture process.

The mura correction process calculates correction data for the display panel, and the calculated correction data is stored in the flash memory of the display unit. The correction data stored in the flash memory is used to correct the input data when the display is actuated. The mura according to the physical characteristics of the display panel may be corrected.

The Background section of the present Specification includes information that is intended to provide context to example embodiments, and the information in the present Background section does not necessarily constitute prior art.

SUMMARY

Aspects of some example embodiments of the inventive concept relate to a display device and a method of correcting mura in the display device. For example, some example embodiments of the inventive concept relate a display device for improving mura correction efficiency and a method of correcting mura in the display device.

Aspects of some example embodiments of the inventive concept provide a display device for improving mura correction efficiency.

Aspects of some example embodiments of the inventive concept provide a method of correcting mura in the display device.

According to some example embodiments of the inventive concept, there is provided an display device including a display panel comprising a plurality of pixels, a first memory storing mura correcting data respectively corresponding to a plurality of reference pixels, each of the plurality of reference pixels comprising (n×m) pixels, the mura correcting data correcting mura of a reference pixel ('n' and 'm' are natural numbers being equal to or more than 2), a first correction controller configured to generate mura correcting data of a pixel using the mura correcting data of the reference pixel stored in the first memory, a second memory storing spot correcting data respectively corresponding to a plurality of spot-muras, the spot correcting data correcting a spot-mura of (1×1) pixel, a second correction controller configured to output the spot correcting data from the second memory based on a position data of the spot-mura, and an operation part configured to correct pixel data of the pixel using the mura correcting data and the spot correcting data of the pixel.

In some example embodiments, the second memory may include a first storage part storing coordinate data respectively corresponding to the plurality of spot-muras and weight values respectively corresponding to the plurality of spot-muras and a second storage part storing spot correcting data respectively corresponding to the plurality of spot-muras.

In some example embodiments, the spot correcting data respectively corresponding to the plurality of spot-muras may be sequentially stored according to a position order of the plurality of spot-muras.

In some example embodiments, the second correction controller may include a buffer is configured to receive data bit corresponding to a predetermined mode comprising the spot correcting data and to output the spot correcting data of data bit corresponding to a selected mode.

In some example embodiments, the second correction controller may be configured to request the spot correcting data from the second storage part in a period corresponding to the coordinate data of the spot-mura, and the second storage part may be configured to provide the buffer with the data bit corresponding to the predetermined mode including the spot correcting data in response to the request signal.

In some example embodiments, the spot correcting data may include correction data of a sample grayscale, and is defined as a mode according to a number of the sample grayscale in the spot correcting data, wherein a data bit corresponding to the predetermined mode may be equal to a data bit corresponding to a maximum mode in which the number of the sample grayscale is a maximum.

In some example embodiments, a word of the buffer may be set to a greatest common measure of data bits of a plurality of modes, the word unit being a smallest unit for writing and reading of the buffer.

In some example embodiments, a maximum number of words which may be written in an address of the buffer is set by an input data bit, an output data bit and a word bit.

In some example embodiments, the display device may further include a non-volatile memory storing the mura correcting data of the plurality of reference pixels and the spot correcting data of the plurality of spot-muras.

In some example embodiments, the non-volatile memory may store the spot correcting data of the plurality of spot-muras having a different number according to the plurality of modes.

According to some example embodiments of the inventive concept, there is provided method of driving a display device which includes a plurality of pixels. The method may includes storing mura correcting data respectively corresponding to a plurality of reference pixels in a first memory, each of the plurality of reference pixels comprising (n×m) pixels, the mura correcting data correcting mura of a reference pixel ('n' and 'm' are natural numbers being equal to or more than 2), generating mura correcting data of a pixel using the mura correcting data of the reference pixel stored in the first memory, storing spot correcting data respectively corresponding to a plurality of spot-muras a second memory, the spot correcting data correcting a spot-mura of (1×1) pixel, outputting the spot correcting data from the second memory based on a position data of the spot-mura, and correcting pixel data of the pixel using the mura correcting data and the spot correcting data of the pixel.

In some example embodiments, the method may further include storing coordinate data respectively corresponding to the plurality of spot-muras and weight values respectively corresponding to the plurality of spot-muras in a first storage part and storing the spot correcting data respectively corresponding to the plurality of spot-mura in a second storage part.

In some example embodiments, the spot correcting data respectively corresponding to the plurality of spot-muras may be sequentially stored according to a position order of the plurality of spot-muras.

In some example embodiments, the method may further include requesting the spot correcting data from the second storage part in a period corresponding to the coordinate data of the spot-mura and providing the buffer with the data bit corresponding to the predetermined mode included in the spot correcting data in response to the request signal.

In some example embodiments, the method may further include storing data bit corresponding to a predetermined mode including in the spot correcting data in the buffer, and outputting the spot correcting data of data bit corresponding to a mode from the buffer.

In some example embodiments, the spot correcting data may include correction data of a sample grayscale, and is defined as a mode according to a number of the sample grayscale in the spot correcting data, wherein a data bit corresponding to the predetermined mode may be equal to a data bit corresponding to a maximum mode in which the number of the sample grayscale is a maximum.

In some example embodiments, a word of the buffer may be set to a greatest common measure of data bits of a plurality of modes, the word unit being a smallest unit for writing and reading of the buffer.

In some example embodiments, a maximum number of words which is written in an address of the buffer may be set by an input data bit, an output data bit and a word bit.

In some example embodiments, the method may further include storing the mura correcting data of the plurality of reference pixels and the spot correcting data of the plurality of spot-muras stored in a non-volatile memory into the first and second memory during an initial booting period or an initialization driving period.

In some example embodiments, the non-volatile memory may store the spot correcting data of the plurality of spot-muras having a difference number according to the plurality of modes.

According to some example embodiments of the inventive concept, the mura of the (n×m) pixels may be corrected using the mura correcting data of the reference pixel including the (n×m) pixels and the spot-mura of the (1×1) pixel may be corrected using spot correcting data. In addition, a size of memory may be decreased by using the mura correcting data of the reference pixel and precise mura correction may be performed by correcting the spot-mura for the pixel where the spot-mura occurs.

BRIEF DESCRIPTION OF THE DRAWINGS

The above and other features and aspects of the inventive concept will become more apparent by describing in more detail aspects of some example embodiments thereof with reference to the accompanying drawings, in which:

FIG. 6 is a conceptual diagram illustrating a method of controlling a buffer according to some example embodiments;

FIGS. 7A and 7B are conceptual diagrams illustrating a buffer according to some example embodiments;

DETAILED DESCRIPTION

Hereinafter, aspects of some example embodiments of the inventive concept will be explained in more detail with reference to the accompanying drawings.

Figure 1:
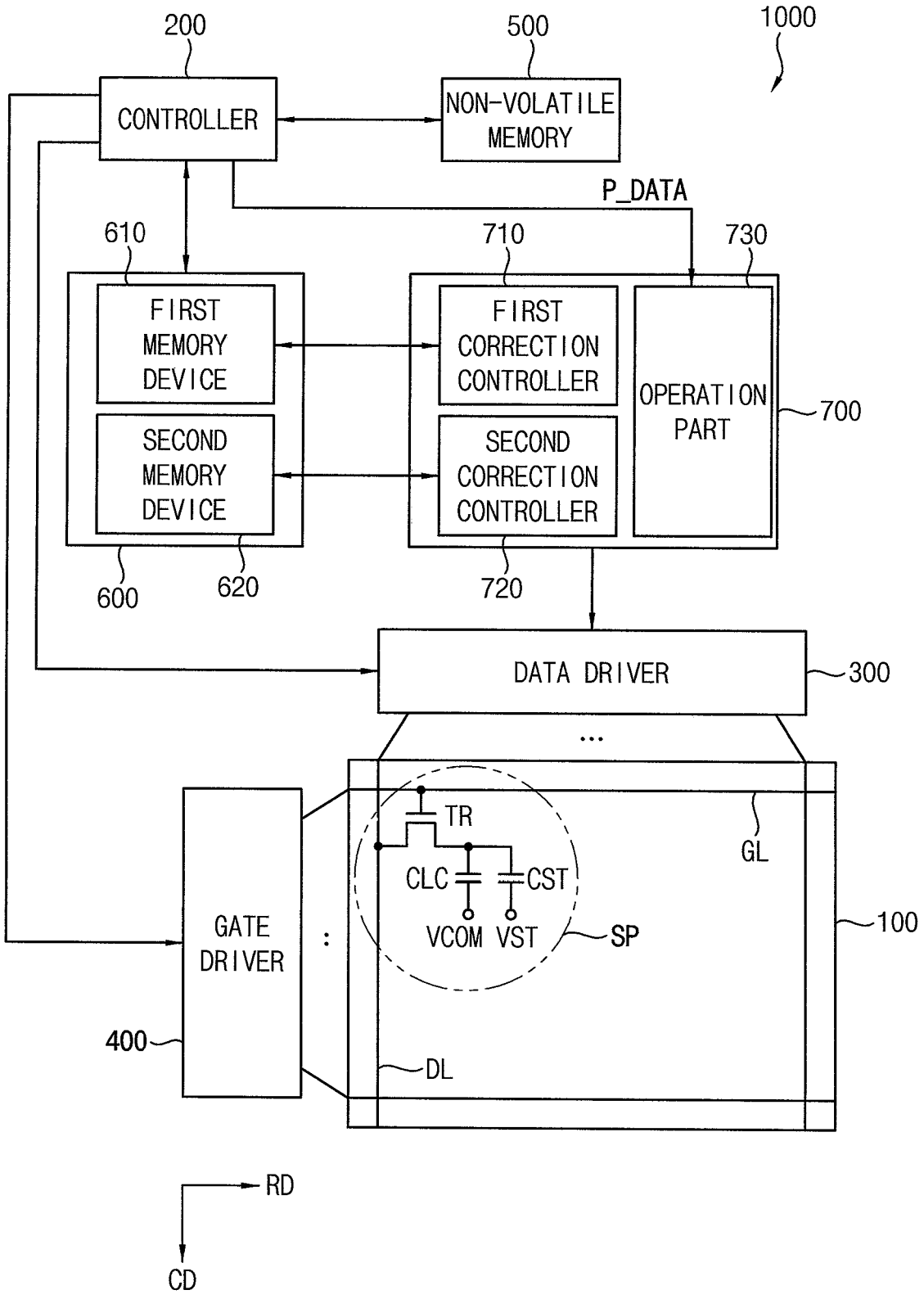
FIG. 1 is a block diagram illustrating a display device according to some example embodiments.
Figure 2:
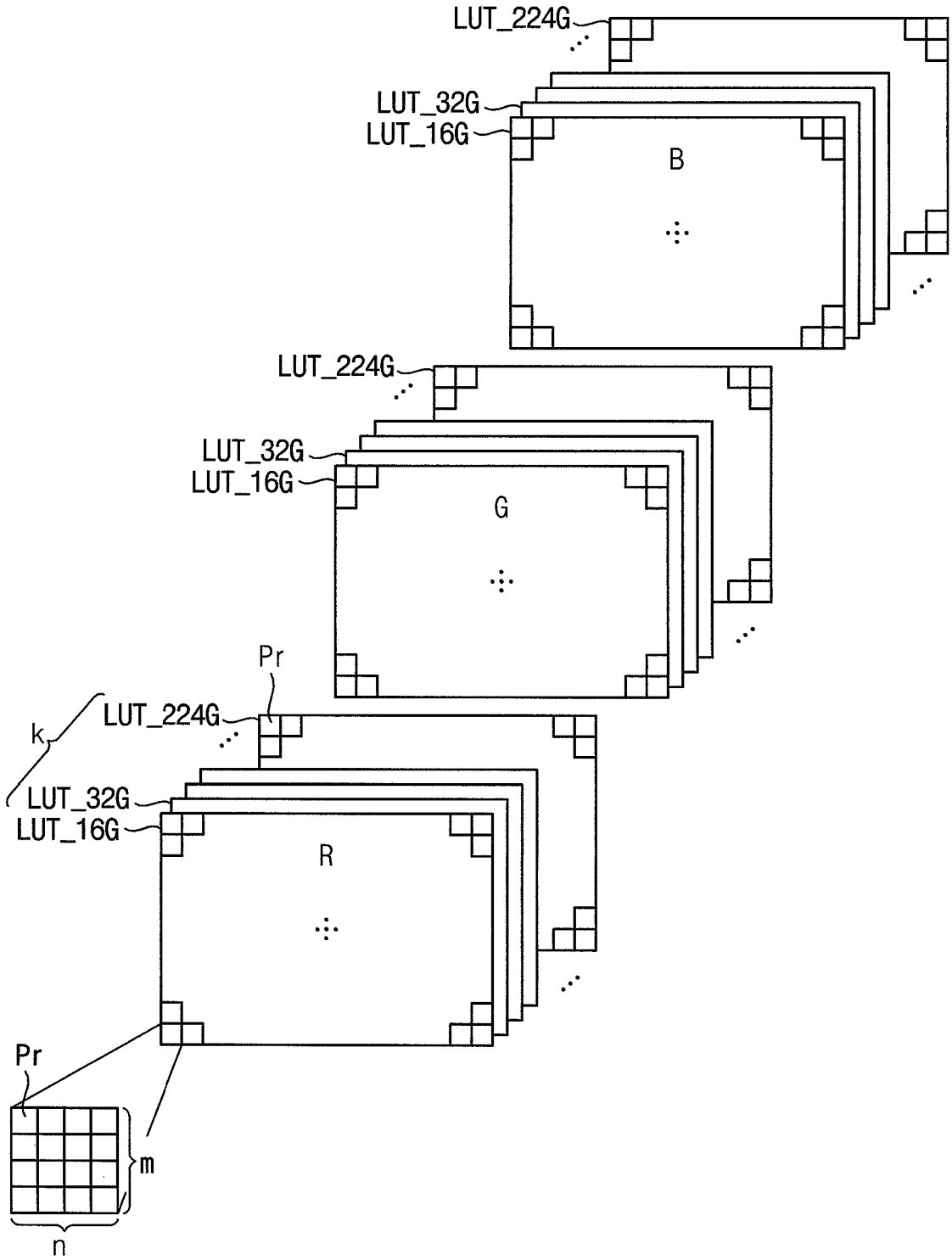
FIG. 2 is a conceptual diagram illustrating correction data stored in a first memory according to some example embodiments.
Figure 3:
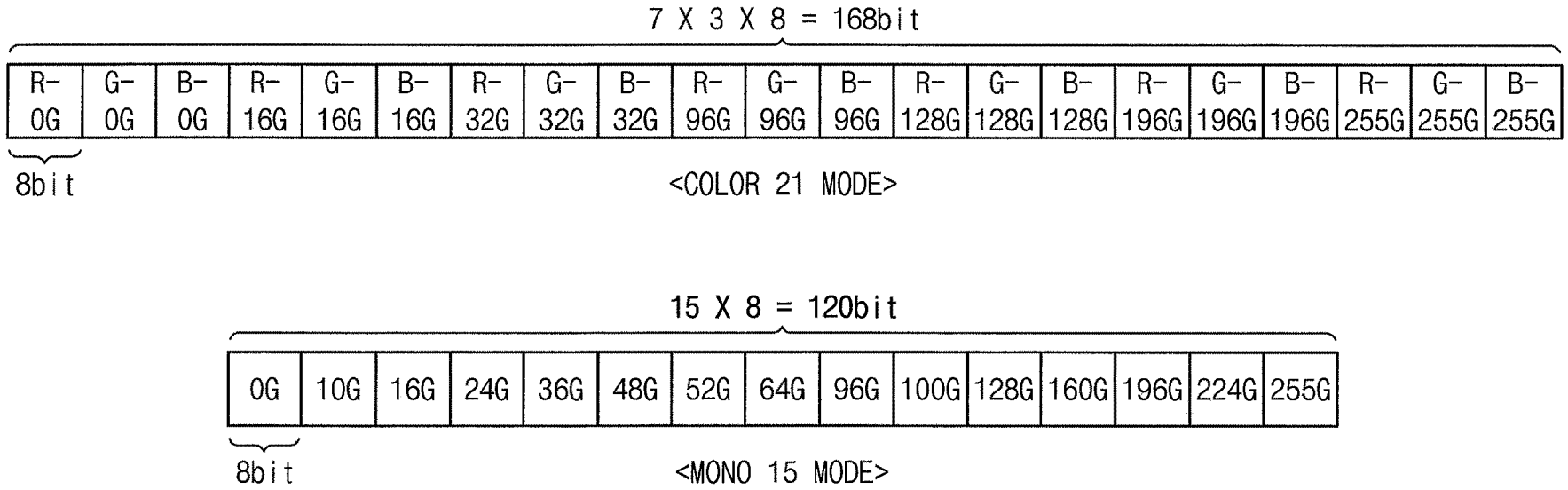
FIG. 3 is a data format diagram illustrating correction data of a mode according to some example embodiments.

FIG. 1 is a block diagram illustrating a display device according to some example embodiments. FIG. 2 is a conceptual diagram illustrating correction data stored in a first memory according to some example embodiments. FIG. 3 is a data format diagram illustrating correction data of a mode according to some example embodiments.

Referring to FIG. 1, the display device 1000 may include a display panel 100, a controller 200, a data driver 300, a gate driver 400, a non-volatile memory 500, a memory device 600 and a data correction part 700.

The display panel 100 may include a plurality of data lines DL, a plurality of gate lines GL and a plurality of sub pixels SP. The sub pixels SP may include a plurality of color sub pixels. For example, a pixel may include a red sub pixel, a green sub pixel, and a blue sub pixel.

The plurality of data lines DL extends in a column direction CD and is arranged in the row direction RD crossing the column direction CD. The plurality of gate lines GL extends in the row direction RD and is arranged in the column direction CD.

The plurality of sub pixels SP may be arranged as a matrix type which includes a plurality of pixel rows and a plurality of pixel columns. Each of sub pixels SP includes a display element such as a liquid crystal capacitor, an organic light emitting diode, and a micro light emitting diode.

According to some example embodiments, the display element may b the liquid crystal capacitor.

Each sub pixel SP may include a transistor TR connected to a data line DL and a gate line GL, a liquid crystal capacitor CLC connected to the transistor TR and a storage capacitor connected to the liquid crystal capacitor CLC. The liquid crystal capacitor CLC receives a liquid crystal common voltage VCOM, and the storage capacitor CST receives a storage common voltage VST. The liquid crystal common voltage VCOM and the storage common voltage VST may be the same as each other.

The controller 200 may control operations of the data driver 300, the gate driver 400, the non-volatile memory 500 and the memory device 600. The controller 200 is configured to store data stored in the non-volatile memory 500 into the memory device 600 during an initial booting period or an initialization driving period of the display device 100.

The data driver 300 is configured to convert image data to a data voltage using a gamma voltage and to output the data voltage to the plurality of data lines DL based on a control of the controller 200.

The gate driver 400 is configured to generate a gate signal and to sequentially output the gate signal to the plurality of gate lines GL based on a control of the controller 200.

The non-volatile memory 500 is configured to store drive information data for driving the display device and mura correcting data and spot-mura correcting data for correcting the pixel data according to electrical and optical characteristics. The drive information data may include information data for a driving voltage, a panel driving voltage, a driving timing, etc. The non-volatile memory 500 may further include mode indication data corresponding to a number of sample grayscales in the correction data.

The memory device 600 may include a first memory 610 and second memory 630. The memory device 600 is configured to store data readout from the non-volatile memory 500 during a period in which the display device is driven.

The first memory 610 is configured to store mura correcting data respectively correspond to the plurality of reference pixels. The reference pixel may include (n×m) pixels (wherein, 'n' and 'm' are natural number being equal to or more than 2).

Referring to FIG. 2, the first memory 610 may include k look up tables LUT_16G, LUT_32G, . . . , LUT_224G respectively corresponding to k sample grayscales 16G, 32G, . . . , 224G. Each of the look up tables may include the mura correcting data respectively corresponding to a plurality of reference pixels Pr. The reference pixel Pr may include (n×m) pixels, for example, (4×4) pixels, (8×8) pixels, (16×16) pixels, etc. Considering the number of q colors, a number of the sample grayscales may be (q×k) ('q' and 'k' are natural numbers). The mura correcting data respectively corresponding to (n×m) pixels may be generated by using the mura correcting data of the reference pixel. A size of the first memory 610 may be decreased by 1/(n×m) than the mura correcting data of all pixels corresponding to a resolution of the display panel.

The second memory 620 may store spot correcting data for correcting the spot-mura corresponding to (1×1) pixel and reference data for the spot-mura. The spot correcting data includes correction data corresponding to the number of sample grayscales. The reference data includes X and Y coordinate data and a mura weight value of the spot-mura.

For example, referring to FIG. 3, spot correcting data in a color 21 mode are 168 bit according to 21 sample grayscales and 8 bit correction data of each sample grayscale. That is, the spot correcting data in the color 21 mode include 8 bit correction data corresponding to each of 7 red sample grayscales, 8 bit correction data corresponding to each of 7 green sample grayscales, and 8 bit correction corresponding to each of 7 blue sample grayscales data.

The spot correcting data in a mono 15 mode are 120 bit according to 15 sample grayscales and 8 bit correction data of each sample grayscale.

The data correction part 700 corrects the pixel data of the pixel using the mura correction data and the spot correcting data stored in the memory device 600.

The data correction part 700 includes a first correction controller 710, a second correction controller 720 and an operation part 730.

The first correction controller 710 receives the first mode indication dataMOD_1 from the non-volatile memory 500. The first correction controller 710 generates the mura correcting data of the plurality of pixels by using the mura correcting data of the reference pixel stored in the first memory 610 based on the first mode indication dataMOD_1.

The second correction controller 720 receives the second mode indication dataMOD_2 from the non-volatile memory 500. The second mode indication dataMOD_2 indicates the mode of correction data. The second correction controller 720 receives input data IN_DATA of the data bit corresponding to a maximum mode from the second memory 620 based on second mode indication dataMOD_2 and outputs the spot correcting data OUT_DATA of the data bit corresponding to a selected mode based on the second mode indication dataMOD_2. The second correction controller 720 outputs the spot correcting data of the pixel.

TABLE 1

| IN_DATA | OUT_DATA | MODE |
|---|---|---|
| [167:0] | [167:0] | 21 |
| | [143:0] | 18 |
| | [119:0] | 15 |
| | [95:0] | 12 |

Table 1 shows the plurality of modes according to the number of sample grayscales. For example, 21 mode is the case where the number of sample grayscales is 21. The correction data corresponding to each sample grayscale is 8 bit.

Among the plurality of modes, the mode selection may be selected in an inspection process that produces correction data for mura correction depending on the process state or the mura intensity of the panel. Correction data of the selected mode in the inspection process is stored in the non-volatile memory The plurality of modes may include a 21 mode, a 18 mode, a 15 mode and a 12 mode, the bits of the input data input to the buffer are the data bit corresponding to the maximum mode. Referring to Table 1, the bits of the input data may be set by 168 bit which is the data bit of the 21 mode.

The bits of the correction data outputted from the second correction controller 720 may be set differently according to the selected mode. For example, referring to Table 1, the spot correction data outputted from the second correction controller 720 outputs 144-bit spot correcting data when the selection mode is the 18 mode, and 120-bit spot correcting data when the selection mode is the 15 mode.

The operation part 730 corrects the pixel data P_DATA of the pixel and outputs the pixel correcting data using the mura correcting data outputted from the first correction controller 710 and the spot correcting data outputted from the second correction controller 720.

Figure 4:
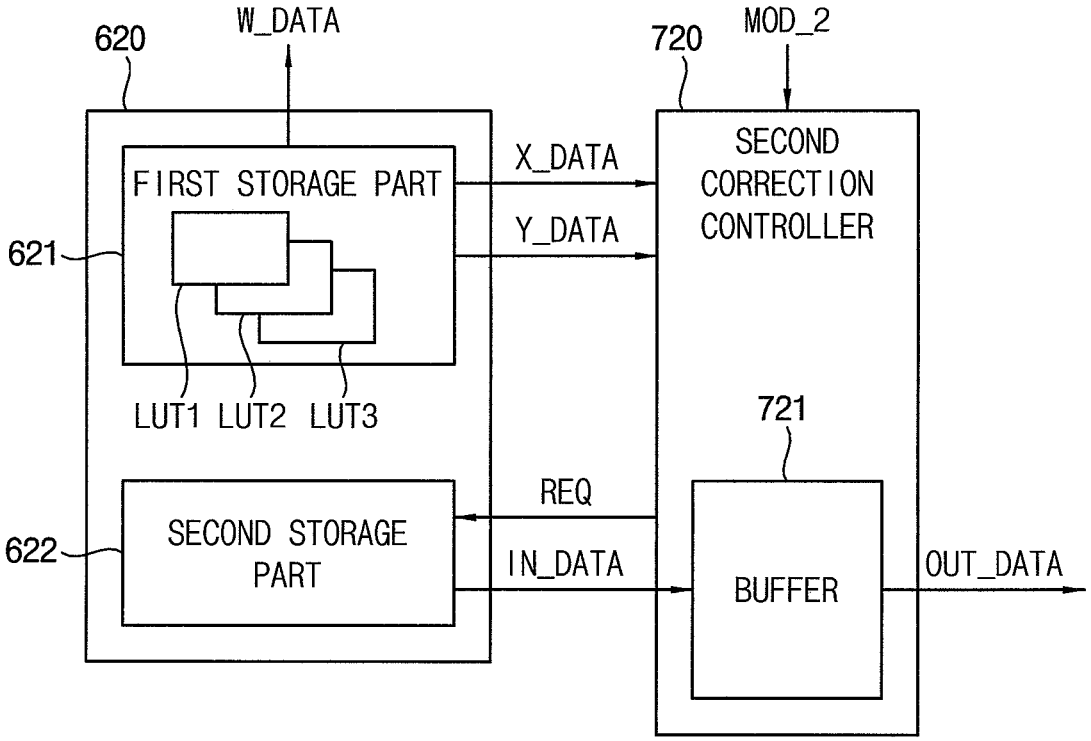
FIG. 4 is a block diagram illustrating a second memory and a second correction controller according to some example embodiments.
Figure 5:
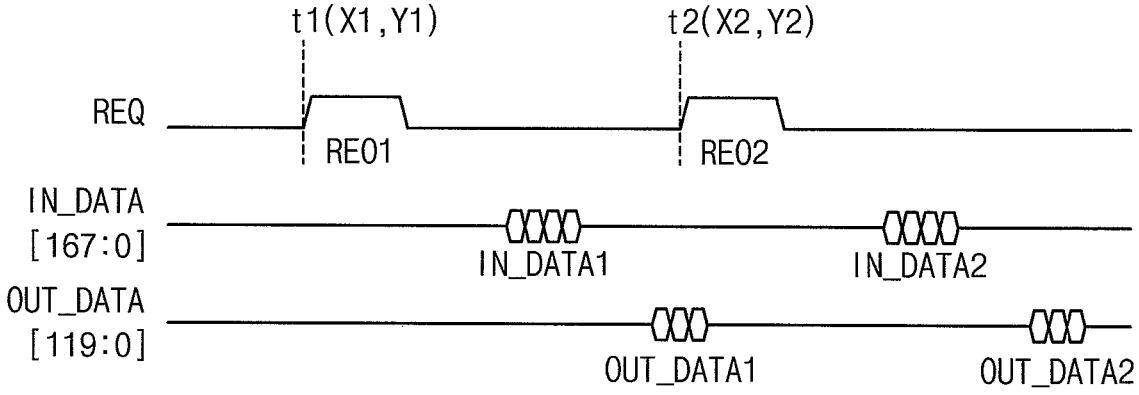
FIG. 5 is a timing diagram illustrating a method of driving the second correction controller according to some example embodiments.

FIG. 4 is a block diagram illustrating a second memory and a second correction controller according to some example embodiments. FIG. 5 is a timing diagram illustrating a method of driving the second correction controller according to some example embodiments.

Referring to FIG. 4, the second memory 620 may include a first storage part 621 and a second storage part 622.

The first storage part 621 stores spot correcting data respectively corresponding to the plurality of spot-muras. The first storage part 621 includes a first look up table LUT1, a second look up table LUT2 and a third look up table LUT3. The first look up table LUT1 stores a plurality of X coordinate data X_DATA respectively corresponding to the plurality of spot-muras. The second look up table LUT2 stores a plurality of Y coordinate data Y_DATA respectively corresponding to the plurality of spot-muras. The third look up table LUT3 stores a plurality of mura weight values W_DATA respectively corresponding to the plurality of spot-muras.

The X coordinate data X_DATA and Y coordinate data Y_DATA respectively corresponding to the plurality of spot-muras is applied to the second correction controller 720.

The plurality of spot-muras respectively corresponding to the plurality of mura weight values W_DATA may be applied to the operation part 730.

The second storage part 622 stores the plurality of spot correcting data respectively corresponding to the plurality of spot-muras. The spot correcting data may be sequentially stored according to a position order of the plurality of spot-muras.

The second correction controller 720 includes a buffer 721.

The second correction controller 720 receives the X coordinate and Y coordinate data X_DATA and Y_DATA of each spot-mura from the first storage part 621.

The second correction controller 720 transmits a request signal REQ to the second storage part 622. The request signal REQ requests the spot correcting data based on the X coordinate and Y coordinate data X_DATA and Y_DATA of each spot-mura during a period corresponding to the position of the spot-mura. The second storage part 622 provides the buffer 721 with the input data IN_DATA of the data bit corresponding to the maximum mode including the spot correcting data of the spot-mura in response to the request signal REQ.

The buffer 721 stores the input data IN_DATA of the data bit corresponding to the maximum mode and, outputs the spot correcting data OUT_DATA of the data bit corresponding to the selected mode based on the second mode indication dataMOD_2.

Referring to FIG. 5, the second correction controller 720 transmits a first request signal REQ1 to the second storage part 622 requesting the spot correcting data of the first spot-mura in the first period t1 corresponding to the positions X1 and X2 of the first spot-mura.

The second storage part 622 provides the buffer 721 with the input data IN_DATA1 of the data bit corresponding to the maximum mode including the spot correcting data of the first spot-mura in response to the first request signal REQ1. The buffer 721 stores the input data IN_DATA1 of the data bit corresponding to the maximum mode and outputs the first spot correcting data OUT_DATA1 of the data bit corresponding to the selected mode based on the second mode indication dataMOD_2.

As the described above, the second correction controller 720 transmits a second request signal REQ2 requesting spot correcting data of the second spot-mura to the second storage part 622 in the second interval T2 corresponding to the position X1 and X2 of the second spot-mura in the next step.

The second storage part 622 provides the buffer 721 with the input data IN_DATA2 of the data bit corresponding to the maximum mode including the spot correcting data of the second spot-mura in response to the second request signal REQ2. The buffer 721 stores the data IN_DATA2 of the data bit corresponding to the maximum mode in the buffer 721 and outputs the second spot correcting data OUT_DATA2 of the data bit corresponding to the selected mode based on the second mode indication dataMOD_2.

FIG. 6 is a conceptual diagram illustrating a method of controlling a buffer according to some example embodiments. FIGS. 7A and 7B are conceptual diagrams illustrating a buffer according to some example embodiments.

Referring to FIG. 6, according to some example embodiments, the buffer 721 is allocated as a plurality of addresses, and the buffer 721 has a word (WORD: WD) which is a minimum unit for writing and reading and a maximum word number (DEPTH: DP) which is the maximum number of words written to one address.

Referring to FIG. 7A, a size (bit) of the word WD may be set to the greatest common measure of the number of data bits of the plurality of modes.

For example, when the plurality of modes includes a 21 mode, a 18 mode, a 15 mode and a 12 mode, the bit number of the word WD may be set as the greatest common measure (24) of the number (168) of data bits of the 21 mode, the number (144) of data bits of the 18 mode, the number (120) of data bits of the 15 mode and the number (96) of data bits of the 12 mode.

Referring to FIG. 7B, the depth DP of the buffer may be set according to the selected mode of the plurality of modes.

The depth DP of the buffer is a value obtained by dividing a subtracting value by the number of bits of the word WD. The subtracting value is obtained by subtracting the greatest common measure (4) for the bit number (1) of the input data and the bit number (2) of the output data from a sum value 3 obtained by adding the bit number (1) of the input data and the bit number (2) of the output data.

For example, when the mode of the correction data is the 21 mode, the bits of the input data are 168 bits, which is the data bit corresponding to the maximum mode, and the bits of the output data are 168 bits, which is the data bit corresponding to the selected mode. Accordingly, the depth DP of the 21 mode is 7. That is, up to 7 words may be written to one address.

When the mode of the correction data is the 18 mode, the input data is the maximum mode bit, 168 bits, and the output data is the 18 mode bits, 144 bits. Accordingly, the depth DP of the 18 mode is 12. That is, up to 12 words may be written to one address.

When the mode of the correction data is the 15 mode, the input data is the data bit corresponding to the maximum mode, 168 bits, and the output data is the data bit corresponding to the 15 mode, 120 bits. Accordingly, the depth DP of the 15 mode is 11. That is, up to 11 words may be written to one address.

When the mode of the correction data is the 12 mode, the input data is the data bit corresponding to the maximum mode, 168 bits, and the output data is the data bit corresponding to the 12 mode, 96 bits. Accordingly, the depth DP of the 12 modes is 10. That is, up to 10 words may be written to one address.

Referring to FIGS. 4 and 6, when the selected mode is the 15 mode, a method of controlling the buffer is explained.

For example, in a previous period being prior to a first period T1, the second correction controller 720 transmits a request signal to the second storage part 622 requesting the spot correcting data of the first spot-mura.

In the first period T1, the second storage part 622 outputs first input data of 168 bits (corresponding to the maximum mode) including the spot correcting data of the first spot-mura to the buffer 721 in response to the request signal received from the second correction controller 720.

The second correction controller 720 writes the first input data of the 168 bits in the first address AD1 of the buffer 721 in 24 bits in a word unit as first to seventh words A0, A1, A2, A3, A4, A5 and A6.

The second correction controller 720 outputs the first to fifth words A0, A1, A2, A3, A4 of the first input data corresponding to the data bit (120 bits) of the 15 mode that is the selected mode among the data written in the first address AD1 as the spot correcting data of the first spot-mura.

In a second period T2, the second correction controller 720 writes the sixth and seventh words A5 and A6 of the first input data not outputted in the first address AD1 to a second address AD2, and requests the second storage part 622 for the spot correcting data of a second spot-mura. The second storage part 622 outputs second input data of 168 bits (corresponding to the maximum mode) including spot correcting data of a second spot-mura to the buffer 721 in response to the request signal received from the second correction controller 720.

The second correction controller 720 writes the sixth and seventh words A5 and A6 of the first input data in a second address AD2 and then, writes the second input data of the 168 bits in the second address AD2 of the buffer 721 in the word unit as first to seventh words B0, B1, B2, B3, B4, B5 and B6.

The second correction controller 720 outputs the sixth and seventh words A5 and A6 of the first input data and the first to third words B0, B1 and B2 of the second input data corresponding to the data bit (120 bits) of the 15 mode among the data written in the second address AD2 as the spot correcting data of the second spot-mura.

In a third period T3, the second correction controller 720 writes the fourth to seventh words B3, B4, B5 and B6 of the second input data not outputted in the second address AD2 to a third address AD3, and requests the second storage part 622 for the spot correcting data of a third spot-mura. The second storage part 622 outputs third input data of 168 bits (corresponding to the maximum mode) including spot correcting data of a third spot-mura to the buffer 721 in response to the request signal received from the second correction controller 720.

The second correction controller 720 writes the fourth to seventh words B3, B4, B5, and B6 of the second input data in the third address AD3 and then, writes the third input data of the 168 bits in the third address AD3 of the buffer 721 in the word unit as first to seventh words C0, C1, C2, C3, C4, C5 and C6.

The second correction controller 720 outputs the fourth to seventh words B3, B4, B5, and B6 of the second input data and the first word C1 of the third input data corresponding to the data bit (120 bits) of the 15 mode among the data written in the third address AD3 as the spot correcting data of the third spot-mura.

In a fourth period T4, the second correction controller 720 writes the second to seventh words C1, C2, C3, C4, C5, and C6 of the third input data not outputted in the third address AD3 to a fourth address AD4.

The second to sixth words C1, C2, C3, C4, and C5 of the third input data corresponding to the data bit (120 bits) of the 15 mode is written in the fourth address AD4. Thus, the second correction controller 720 does not request the second storage part 622 for the spot correcting data of a fourth spot-mura.

The second correction controller 720 outputs the second to sixth words C1, C2, C3, C4, and C5 of the third input data corresponding to the data bit (120 bits) of the 15 mode written in the fourth address AD4 as the spot correcting data of the fourth spot-mura.

In a fifth period T5, the second correction controller 720 writes the seventh word C6 of the third input data not outputted in the fourth address AD4 to a fifth address AD5 and requests the second storage part 622 for the spot correcting data of a fifth spot-mura. The second storage part 622 outputs fourth input data of 168 bits (maximum mode bit) including spot correcting data of a fifth spot-mura to the buffer 721 in response to the request signal received from the second correction controller 720.

The second correction controller 720 writes the seventh word C6 of the third input data in the fifth address AD5 and then, writes the fourth input data of the 168 bits in the fifth address AD5 of the buffer 721 in the word unit as first to seventh words D0, D1, D2, D3, D4, D5, and D6.

The second correction controller 720 outputs the seventh word C6 of the third input data and the first to fourth words D0, D1, D2, and D3 of the fourth input data corresponding to the data bit (120 bits) of the 15 mode among the data written in the fifth address AD5 as the spot correcting data of the fifth spot-mura.

In a sixth period T6, the second correction controller 720 writes the fifth to seventh word D4, D5, D6 of the fourth input data not outputted in the fifth address AD5 to a sixth address AD6, and requests the second storage part 622 for the spot correcting data of a sixth spot-mura. The second storage part 622 outputs fifth input data of 168 bits (corresponding to the maximum mode) including spot correcting data of a sixth spot-mura to the buffer 721 in response to the request signal received from the second correction controller 720.

The second correction controller 720 writes the fifth to seventh word D4, D5 and D6 of the fourth input data in the sixth address AD6 and then, writes the fifth input data of the 168 bits in the sixth address AD6 of the buffer 721 in the word unit as first to seventh words E0, E1, E2, E3, E4, E5, and E6.

The second correction controller 720 outputs the fifth to seventh word D4, D5, and D6 of the fourth input data and the first and second words E0 and E1 of the fifth input data corresponding to the data bit (120 bits) of the 15 mode among the data written in the sixth address AD6 as the spot correcting data of the sixth spot-mura.

In a seventh period T7, the second correction controller 720 writes the third to seventh words E2, E3, E4, E5, and E6 of the fifth input data not outputted in the sixth address AD6 to a seventh address AD7.

The third to seventh words E2, E3, E4, E5, and E6 of the fifth input data corresponding to the data bit (120 bits) of the 15 mode is written in the seventh address AD7. Thus, the second correction controller 720 does not request the second storage part 622 for the spot correcting data of a seventh spot-mura.

The second correction controller 720 outputs third to seventh words E2, E3, E4, E5, and E6 of the fifth input data corresponding to the data bit (120 bits) of the 15 mode written in the seventh address AD7 as the spot correcting data of the fourth spot-mura.

As the described above, the word being the minimum data unit of writing and reading of the buffer and a depth being the maximum number of words written in the address may be set corresponding to the plurality of modes. The number of input data bits in the buffer is set to the number of data bits in the maximum mode and the number of output data bits in the buffer is set to the number of data bits in the selected mode. Thus, the spot correcting data corresponding to the mode may be outputted.

TABLE 2

| Number of corrected spots | | |
|---|---|---|
| MODE | COLOR (RGB) | MONO |
| 12 | 10,000 | 30,000 |
| 11 | 10,909 | 32,727 |
| 10 | 12,000 | 36,000 |
| 9 | 13,333 | 40,000 |
| 8 | 15,000 | 45,000 |
| 7 | 17,143 | 51,429 |
| 6 | 20,000 | 60,000 |

Table 2 shows the number of spot-mura that may be corrected for each mode.

For example, the nonvolatile memory stores 8,800,000 bits (=8×12×3×10000) for 8-bit correction data for correcting the spot-mura. The nonvolatile memory may store the spot correcting data for correcting 10,000 spot-muras in the color 12 mode. The nonvolatile memory may store the spot correcting data for correcting 60,000 spot-muras in the mono 6 mode.

According to some example embodiments, by using the buffer and a method of controlling the buffer, the spot-mura may be efficiently corrected according to the mode as shown in Table 2.

Figure 8:
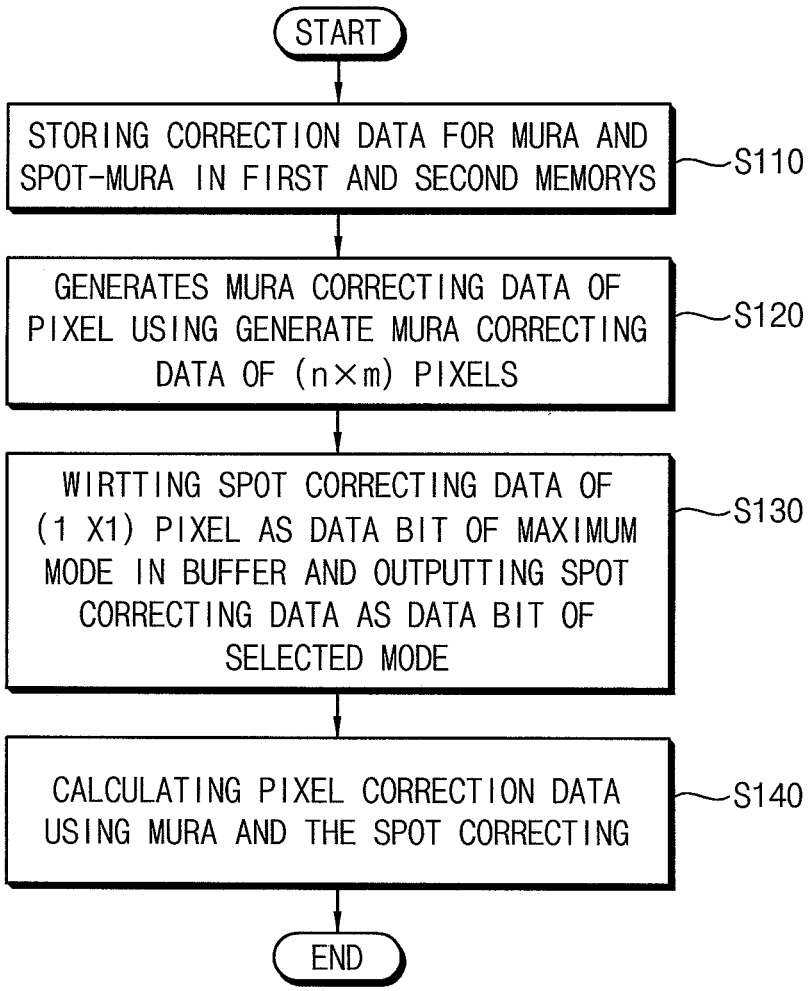
FIG. 8 is a flowchart diagram illustrating a method of correcting mura of a display device according to some example embodiments.
Figure 9:
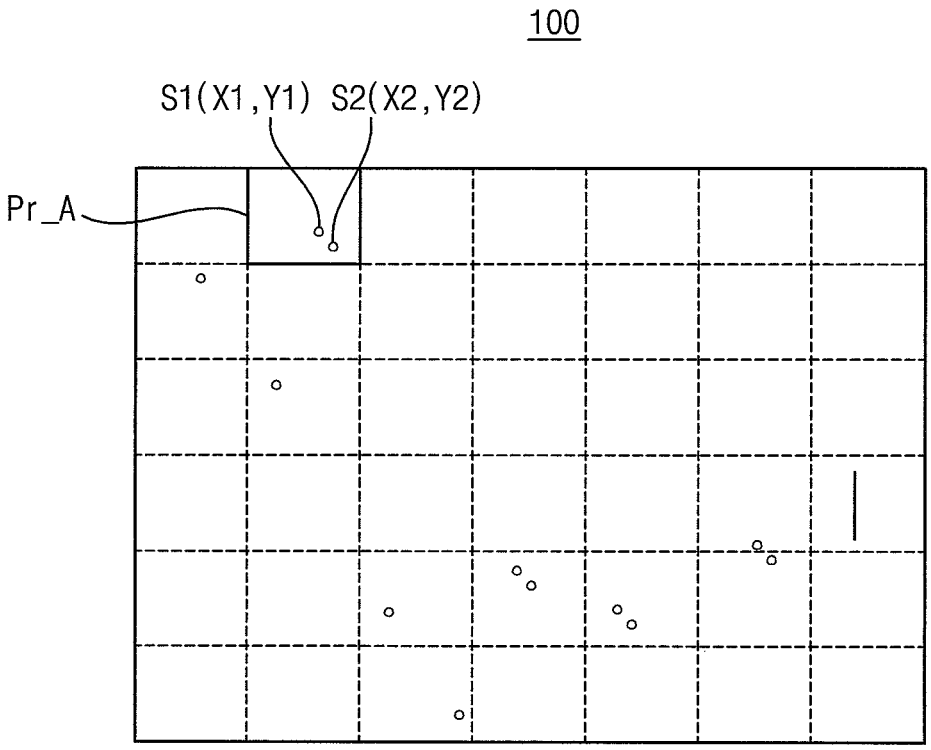
FIG. 9 is a conceptual diagram illustrating a method of correcting mura of a display device according to some example embodiments.

FIG. 8 is a flowchart diagram illustrating a method of correcting mura of a display device according to some example embodiments. FIG. 9 is a conceptual diagram illustrating a method of correcting mura of a display device according to some example embodiments.

Referring to FIGS. 1, 4, 8 and 9, during an initial booting period or an initialization driving period of the display device 1000, the correction data for mura and spot-mura stored in the non-volatile memory 500 is stored in the first memory 610 and the second memory 620 (Step S110).

The display device 1000 is configured to correct the pixel data using the mura correcting data and the spot correcting data stored in the first memory 610 and the second memory 620.

For example, a method of correcting mura in the reference pixel Pr_A of the display panel 100 is explained.

Referring to FIG. 9, the reference pixel Pr includes a first spot-mura 51 and a second spot-mura S2.

The first correction controller 710 is configured to generate mura correcting data of (n×m) pixels included in the reference pixel Pr_A using mura correcting data of the reference pixel Pr_A and adjacent reference pixel adjacent to the reference pixel Pr_A stored in the first memory 610. The first correction controller 710 generates the mura correcting data of the first pixel having the first spot-mura 51 and the second pixel having the second spot-mura S2 (Step S120).

Referring to FIG. 4, the second correction controller 710 transmits a first request signal for requesting for spot correcting data to the second storage part 622 based on a first coordinate data X1 and Y1 of the first spot-mura 51 provided from the first storage part 621.

The second storage part 622 outputs first input data of 168 bits (corresponding to the maximum mode) including spot correcting data of the first spot-mura 51 to the buffer 721. The second correction controller 720 outputs the data of 120 bits corresponding to the data bit of the 15 mode that is the selected mode among the data stored in the buffer 721 as spot correcting data of the first spot-mura 51 (Step S130).

The operation part 730 calculates pixel correction data of the first pixel using the mura correcting data of the first pixel provided from the first correction controller 710, the spot correcting data of the first pixel provided from the second correction controller 720 and the mura weight value of the first pixel provided from the first storage part 621 (Step S140).

Then, the second correction controller 710 transmits a second request signal for requesting for spot correcting data to the second storage part 622 based on a second coordinate data X2 and Y2 of the second spot-mura S2 provided from the first storage part 621.

The second storage part 622 outputs first input data of 168 bits (corresponding to the maximum mode) including spot correcting data of the first spot-mura 51 to the buffer 721. The second correction controller 720 outputs the data of 120 bits corresponding to the data bit of the 15 mode that is the selected mode among the data stored in the buffer 721 as spot correcting data of the second spot-mura S2 (Step S130)

The operation part 730 calculates pixel correction data of the second pixel using the mura correcting data of the second pixel provided from the first correction controller 710, the spot correcting data of the second pixel provided from the second correction controller 720 and the mura weight value of the second pixel provided from the first storage part 621 (Step S140).

According to some example embodiments, mura and spot-mura of the display panel may be corrected.

According to some example embodiments, the mura of the (n×m) pixels may be corrected using the mura correcting data of the reference pixel including the (n×m) pixels and the spot-mura of the (1×1) pixel may be corrected using spot correcting data. In addition, a size of memory may be decreased by using the mura correcting data of the reference pixel and precise mura correction may be performed by correcting the spot-mura for the pixel where the spot-mura occurs.

Aspects of some example embodiments of the present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of the inventive concept and is not to be construed as limiting thereof. Although a few example embodiments of the inventive concept have been described, those skilled in the art will readily appreciate that many modifications are possible in the example embodiments without materially departing from the novel teachings and aspects of the inventive concept. Accordingly, all such modifications are intended to be included within the scope of the inventive concept as defined in the claims. In the claims, means plus function clauses are intended to cover the structures described herein as performing the recited function and not only structural equivalents but also equivalent structures. Therefore, it is to be understood that the foregoing is illustrative of the inventive concept and is not to be construed as limited to the specific example embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device comprising:

a display panel comprising a plurality of pixels;

a first memory storing mura correcting data respectively corresponding to a plurality of reference pixels, each of the plurality of reference pixels comprising (n×m) pixels, the mura correcting data configured to correct mura of a reference pixel ('n' and 'm' are natural numbers being equal to or more than 2);

a first correction controller configured to generate mura correcting data of a pixel using the mura correcting data of the reference pixel stored in the first memory;

a second memory storing spot correcting data respectively corresponding to a plurality of spot-muras, the spot correcting data configured to correct a spot-mura of (1×1) pixel;

a second correction controller configured to output the spot correcting data from the second memory based on a position data of the spot-mura; and an operation part configured to correct pixel data of the pixel using the mura correcting data and the spot correcting data of the pixel.

2. The display device of claim 1, wherein the second memory comprises:

a first storage part storing coordinate data respectively corresponding to the plurality of spot-muras and weight values respectively corresponding to the plurality of spot-muras; and a second storage part storing spot correcting data respectively corresponding to the plurality of spot-muras.

3. The display device of claim 2, wherein the spot correcting data respectively corresponding to the plurality of spot-muras are sequentially stored according to a position order of the plurality of spot-muras.

4. The display device of claim 2, wherein the second correction controller comprises a buffer configured to receive data bit corresponding to a predetermined mode comprising the spot correcting data and to output the spot correcting data of data bit corresponding to a selected mode.

5. The display device of claim 4, wherein the second correction controller is configured to request the spot correcting data from the second storage part in a period corresponding to the coordinate data of the spot-mura; and the second storage part is configured to provide the buffer with the data bit corresponding to the predetermined mode including the spot correcting data in response to the request.

6. The display device of claim 5, wherein the spot correcting data comprises correction data of a sample grayscale, and is defined as a mode according to a number of the sample grayscale in the spot correcting data, wherein a data bit corresponding to the predetermined mode is equal to a data bit corresponding to a maximum mode in which the number of the sample grayscale is a maximum.

7. The display device of claim 6, wherein a word of the buffer is set to a greatest common measure of data bits of a plurality of modes, the word being a smallest unit for writing and reading of the buffer.

8. The display device of claim 6, wherein a maximum number of words written in an address of the buffer is set by an input data bit, an output data bit and a word bit.

9. The display device of claim 6, further comprising:

a non-volatile memory storing the mura correcting data of the plurality of reference pixels and the spot correcting data of the plurality of spot-muras.

10. The display device of claim 9, wherein the non-volatile memory stores the spot correcting data of the plurality of spot-muras having a different number according to a plurality of modes.

11. A method of correcting mura in a display device which comprises a plurality of pixels, the method comprising:

storing mura correcting data respectively corresponding to a plurality of reference pixels in a first memory, each of the plurality of reference pixels comprising (n×m) pixels, the mura correcting data configured to correct mura of a reference pixel ('n' and 'm' are natural numbers being equal to or more than 2);

generating mura correcting data of a pixel using the mura correcting data of the reference pixel stored in the first memory;

storing spot correcting data respectively corresponding to a plurality of spot-muras in a second memory, the spot correcting data configured to correct a spot-mura of (1×1) pixel;

outputting the spot correcting data from the second memory based on a position data of the spot-mura; and correcting pixel data of the pixel using the mura correcting data and the spot correcting data of the pixel.

12. The method of claim 11, further comprising:

storing coordinate data respectively corresponding to the plurality of spot-muras and weight values respectively corresponding to the plurality of spot-muras in a first storage part; and storing the spot correcting data respectively corresponding to the plurality of spot-mura in a second storage part.

13. The method of claim 12, wherein the spot correcting data respectively corresponding to the plurality of spot-muras are sequentially stored according to a position order of the plurality of spot-muras.

14. The method of claim 12, further comprising:

requesting the spot correcting data from the second storage part in a period corresponding to the coordinate data of the spot-mura; and providing a buffer with a data bit corresponding to a predetermined mode included in the spot correcting data in response to the requesting.

15. The method of claim 14, further comprising:

storing a data bit corresponding to the predetermined mode included in the spot correcting data in the buffer; and outputting the spot correcting data of a data bit corresponding to a mode from the buffer.

16. The method of claim 15, wherein the spot correcting data comprises correction data of a sample grayscale, and is defined as a mode according to a number of the sample grayscale in the spot correcting data, wherein a data bit corresponding to the predetermined mode is equal to a data bit corresponding to a maximum mode in which the number of the sample grayscale is a maximum.

17. The method of claim 16, wherein a word of the buffer is set to a greatest common measure of data bits of a plurality of modes, the word being a smallest unit for writing and reading of the buffer.

18. The method of claim 16, wherein a maximum number of words written in an address of the buffer is set by an input data bit, an output data bit and a word bit.

19. The method of claim 16, further comprising:

storing the mura correcting data of the plurality of reference pixels and the spot correcting data of the plurality of spot-muras stored in a non-volatile memory into the first and second memory during an initial booting period or a initialization driving period.

20. The method of claim 19, wherein the non-volatile memory stores the spot correcting data of the plurality of spot-muras having a difference number according to a plurality of modes.

* * * * *